US006115978A

United States Patent [19]

Bastian et al.

[11] Patent Number: 6,115,978

[45] Date of Patent: Sep. 12, 2000

[54] MOVEABLE PARTITION SYSTEM

[75] Inventors: John M. Bastian; Marshall K. Beck, both of Manitowoc, Wis.

[73] Assignee: Fisher Hamilton L.L.C., Two Rivers, Wis.

[21] Appl. No.: 08/941,017

[22] Filed: Sep. 30, 1997

[51] Int. Cl.[7] ..... E04B 2/78

[52] U.S. Cl. ..... 52/243.1; 52/241; 52/36.5; 52/220.7; 52/664

[58] Field of Search ..... 52/36.1, 36.4, 52/36.5, 36.6, 238.1, 239, 241, 243.1, 481.1, 481.2, 243, 506.06, 664, 665, 220.7; 211/162, 94.01, 183; 312/245, 223.6; 160/135, 157

[56] References Cited

U.S. PATENT DOCUMENTS

| | | | |
|---|---|---|---|
| 1,724,821 | 8/1929 | Bohnsack | 52/241 X |
| 2,909,251 | 10/1959 | Nelsson | 52/664 X |
| 2,969,565 | 1/1961 | Levy | 52/481.2 X |
| 3,033,330 | 5/1962 | Fowles et al. | 52/241 X |
| 3,039,569 | 6/1962 | Bohnsack | 52/241 X |
| 3,395,504 | 8/1968 | Zwickert | 52/241 X |
| 3,471,978 | 10/1969 | Fenwick | 52/36.6 |
| 3,492,766 | 2/1970 | Andrews | 52/36.6 |
| 3,557,499 | 1/1971 | Dickie et al. | 52/241 X |
| 3,748,792 | 7/1973 | Tompkins et al. | 52/241 X |
| 3,839,834 | 10/1974 | Goddard | 52/238.1 |
| 3,986,314 | 10/1976 | Moeller | 52/481.2 X |
| 4,018,020 | 4/1977 | Sauer et al. | 52/241 |
| 4,787,767 | 11/1988 | Wendt | 52/241 X |
| 5,328,039 | 7/1994 | Heimendinger | 211/183 |
| 5,638,644 | 6/1997 | Bastian | 52/36.6 |

*Primary Examiner*—Carl D. Friedman
*Assistant Examiner*—Winnie S. Yip
*Attorney, Agent, or Firm*—Tilton, Fallon, Lungmus & Chestnut

[57] ABSTRACT

A moveable partition system includes a main wall member and a telescoping member disposed in telescoping relation with the main wall member. The telescoping member extends between the main wall member and a structural body to connect the wall member to the structural body. A securing assembly secures the telescoping member to the structural body; and a support member engages the structural body opposite the securing assembly to distribute the load of the securing assembly on the structural body.

11 Claims, 6 Drawing Sheets

MOVEABLE PARTITION SYSTEM

BACKGROUND OF THE INVENTION

1. Field of the Invention

The present invention relates to a moveable wall system, and more particularly to a moveable wall system that allows quick and easy connection to ceilings or other structural bodies. Although the present invention finds particular utility in laboratory or office landscape systems, one may use it in a variety of other applications.

2. Description of the Prior Art

The prior art includes a wide variety of partition systems in which multiple prefabricated wall members and related components assume various configurations to define work stations, corridors and other spaces within large otherwise open laboratory or office spaces. The wall members are moveable in that they do not form a permanent part of the building structure. They typically have fixed heights and allow only slight adjustment to accommodate varying ceiling heights. If the ceiling height in a large space or adjoining spaces differs substantially, one must use different wall members.

The partition system of the present invention avoids the disadvantages of the prior art systems. It includes wall members with telescoping extensions that connect the main body of the wall member to a ceiling. These telescoping extensions allow substantial adjustment to accommodate substantially different ceiling heights. Connections between the telescoping extensions and the ceilings or other structural bodies also allow adjustment of the wall member, longitudinally of the wall member.

SUMMARY OF THE INVENTION

In accordance with this invention, a partition system includes a wall member having a main body segment that one may place in spaced relation with a structural body such as a ceiling member and a telescoping segment disposed in telescoping relation with the main body segment. This telescoping segment bridges the space between the main body segment and the structural body to connect the main body segment to the structural body.

An attaching assembly attaches the telescoping segment of the wall member to the structural body. This attaching assembly includes a guide segment secured to the structural body and a slidable segment disposed in sliding relation with the guide segment and secured to the telescoping segment of the wall member. The slidable segment lies in a cavity defined by the guide segment and moves longitudinally of the guide segment. The walls of the cavity limit the movement of the slidable member in a direction transversely of the guide segment.

A support member disposed against the structural body opposite the attaching means distributes the force transferred by the wall member to the structural body. Securing means such as screws secure the support member, the structural body and the attaching assembly together.

BRIEF DESCRIPTION OF THE DRAWINGS

For a more complete understanding of this invention, one should now refer to the embodiment illustrated in greater detail in the accompanying drawings and described below by way of an example of the invention. In the drawings.

While the following disclosure describes the invention in connection with one embodiment and modifications of that embodiment, one should understand that the invention is not limited to this embodiment and modifications. Furthermore, one should understand that the drawings are not to scale and that graphic symbols, diagrammatic representatives, and fragmentary views, in part, illustrate the embodiment. In certain instances, the disclosure may not include details which are not necessary for an understanding of the present invention such as conventional details of fabrication and assembly.

DETAILED DESCRIPTION OF THE DRAWINGS

Figure 1:
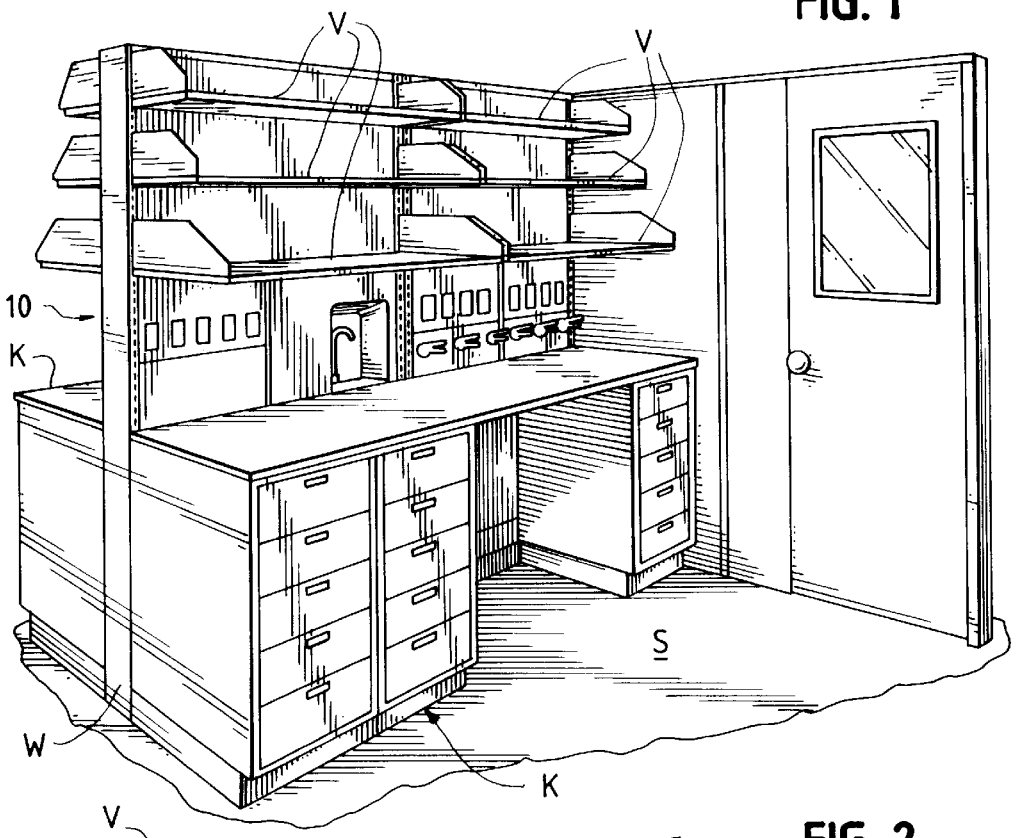
FIG. 1 is a perspective view of a laboratory work station defined by the partition system of the present invention.
Figure 2:
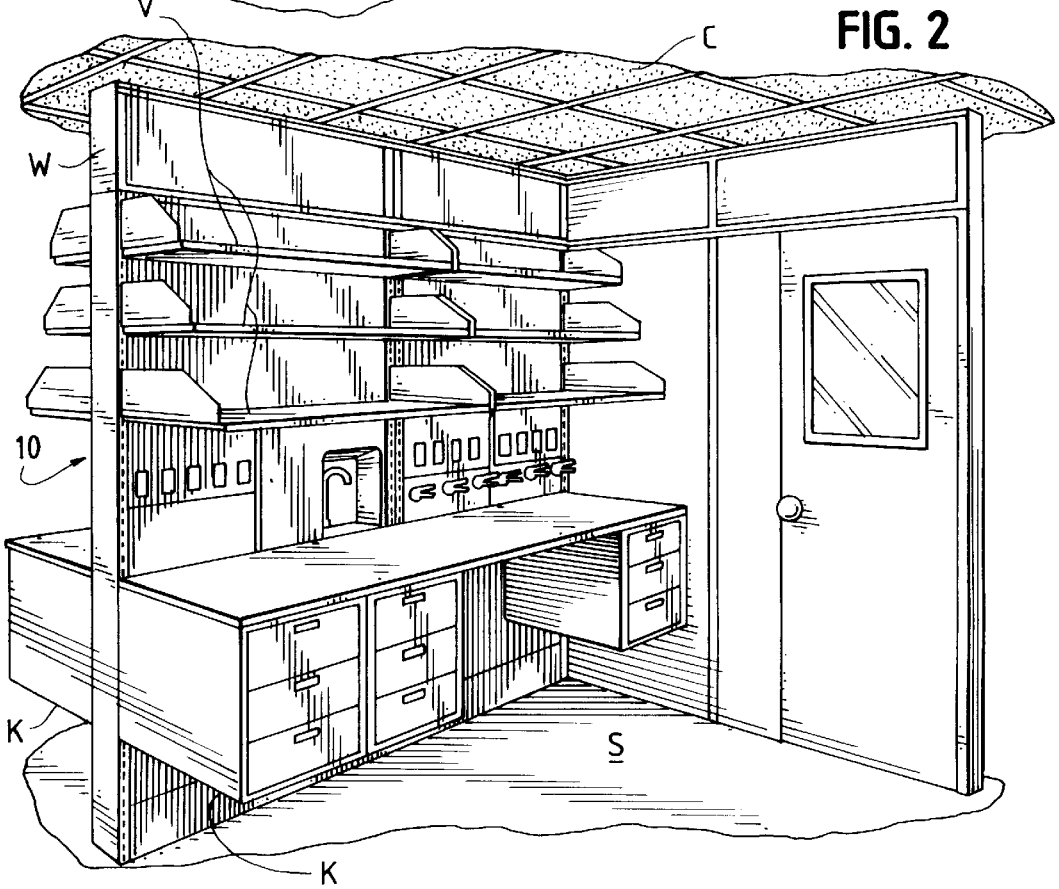
FIG. 2 is a perspective view of another laboratory work station defined by the partition system of the present invention.
Figure 3:
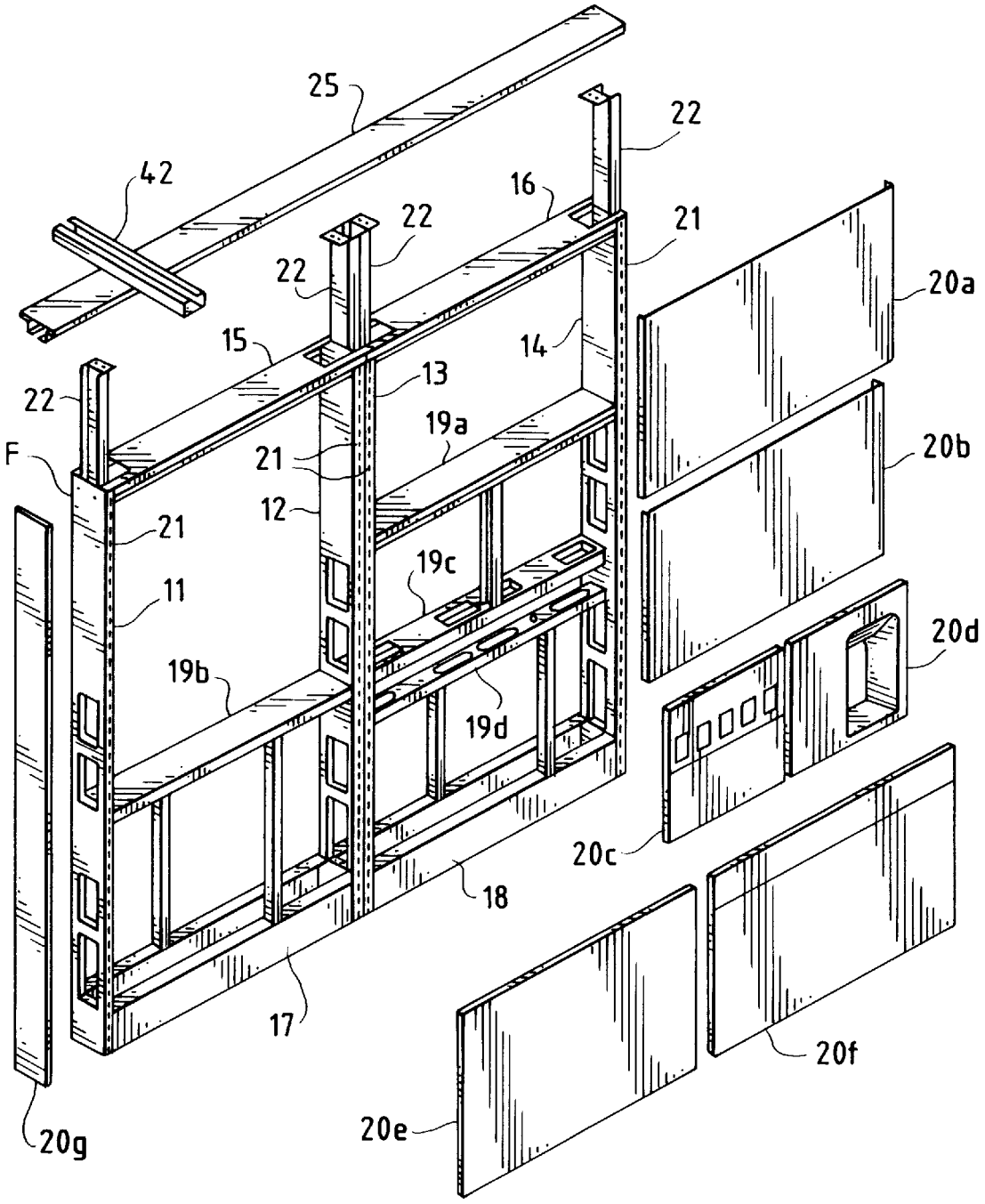
FIG. 3 is an exploded perspective view of a wall member of the partition systems shown in FIGS. 1 and 2.

Turning now to the drawings and referring first to FIGS. 1–3, the partition system of the present invention shown generally at 10 (See FIGS. 1 and 2) defines a laboratory work space within a larger enclosed laboratory space. The partition system 10 lies on a supporting floor surface S and extends between the surface S and a ceiling member C. It includes a wall member W that supports furnishings such as shelving V disposed on the wall member in cantilever fashion as well as cabinets and countertops K that lie on the surface S as shown in FIG. 1 and that hang from the wall member Win cantilever fashion as shown in FIG. 2.

The wall member W includes a frame assembly F comprising vertical columns 11, 12, 13 and 14, top cross beams 15 and 16, bottom cross beams 17 and 18 and intermediate cross beams 19*a–d* (See FIG. 3). The vertical components 11–14 lie in spaced, substantially parallel relation. The horizontal components 15–19 also lie in spaced, substantially parallel relation, but perpendicularly to the vertical components. This construction allows for easy manufacture and assembly, but these components may assume any other suitable arrangement. (All of these components as well as those described below are made of sheet metal such as steel, extruded aluminum or any other material of sufficient strength and rigidity.)

The components 11–19 are hollow members having a predetermined width of sufficient magnitude to allow passage of utility lines, including water, gas, and electricity lines, in the spaces defined by them and cover panels 20*a–f*. The utility lines (not shown) extend into the wall member W through the floor and into cavities in the bottom cross beams 17 and 18 or through openings in the end columns 11 and 14 and then upwardly and across the wall member through openings in its internal components. The panels 20*a–f* include hook portions (not shown) that extend into openings 21 to hang the panels from the columns 11–14. A panel 20*g* extends over the exposed distal end of the frame F over a face of the column 11 to close and finish that end of the frame.

Figure 4:
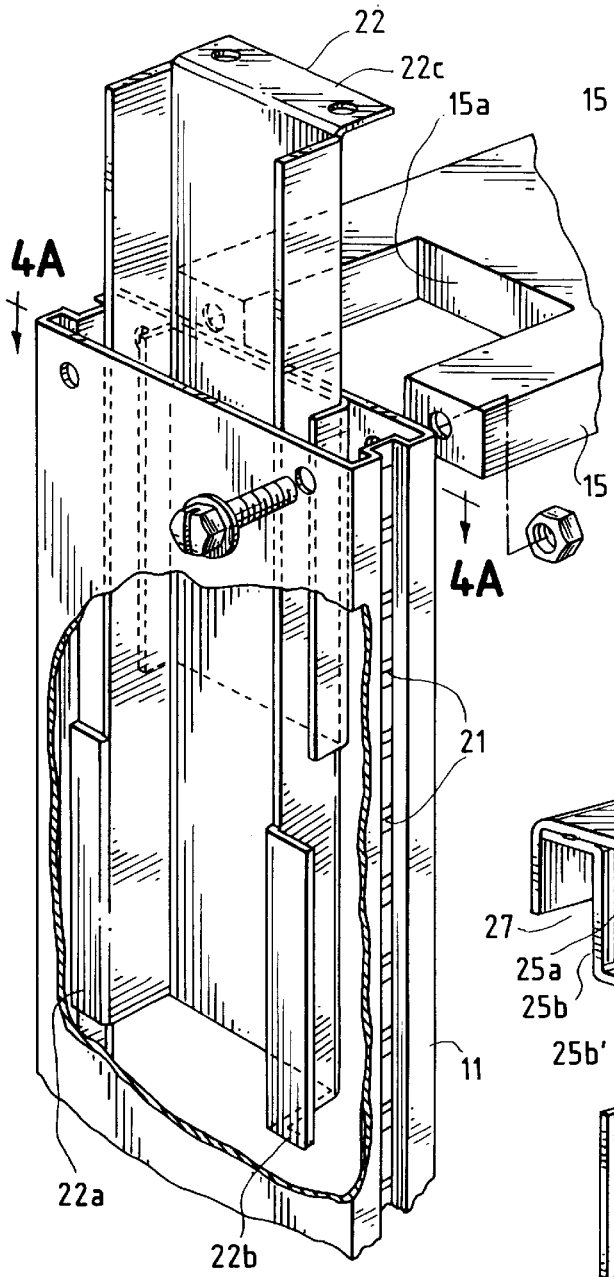
FIG. 4 is a partial perspective view of the telescoping extension used in the wall member of the present invention.
Figure 4A:
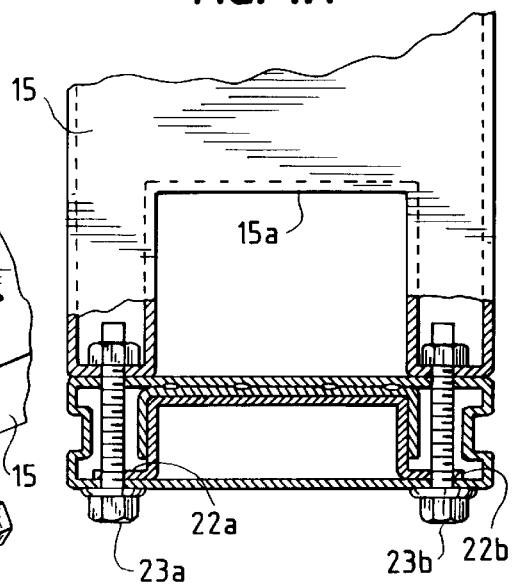
FIG. 4A is a sectional view taken along line 4A—4A in FIG. 4.
Figure 5:
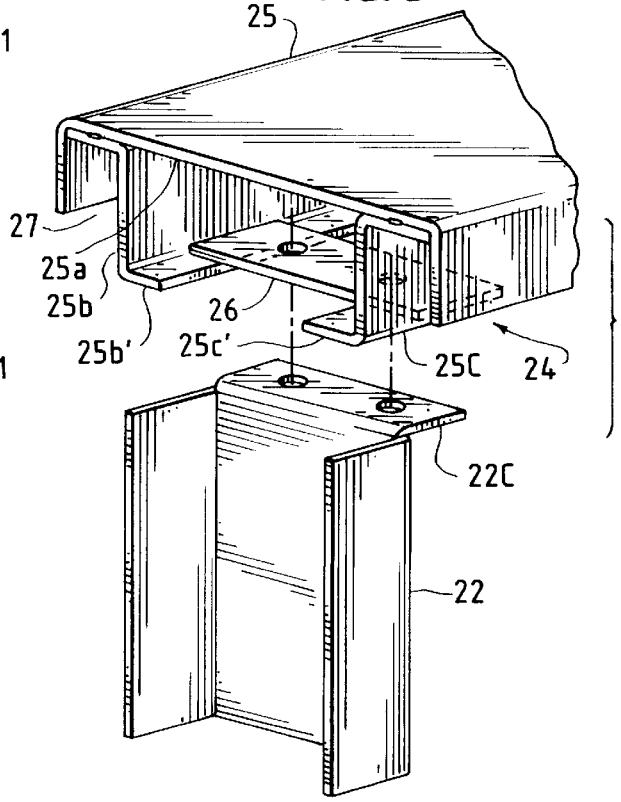
FIG. 5 is a partial perspective view of the telescoping extension and an attaching assembly for attaching the telescoping extension to a structural body such as a ceiling panel.

Each of the columns is open at its top end where it supports a telescoping segment 22. (See FIGS. 4 and 4A.) The telescoping segment 22 is a channel-like component with flanges 22*a* and 22*b* that cooperate with bolts 23*a* and 23*b* to stop the telescoping segment 22 from moving entirely out of the column 11 shown in FIGS. 4 and 4A. The bolts 23*a* and 23*b* extend through the column 11 and also cooperate with nuts threaded at their ends to pinch the column 11 and secure the telescoping segment 22 in a desired position. The segment 22 further includes a flange 22*c* that engages the top distal end of the column 11 to prevent the segment 22 from falling into the column, and it facilitates the connection between the telescoping member and an attaching assembly 24 (See FIG. 5) as described below. The telescoping segments 22 operate in the same manner in the other columns 12–14.

The attaching assembly 24 includes an elongate guide segment 25. It also includes a slidable segment 26 for each telescoping segment 22. The guide segment 25 comprises a C-shaped channel portion 25*a* and two Z-shaped angle portions 25*b* and 25*c* welded or otherwise secured to the portion 25*a* to define slots 27 and 28 on opposite sides of the guide segment 25, a center cavity 29, and a slot 30 through which screws 31 or other suitable securing means connect the flange 22*c* of the telescoping segment 22 and the slidable segments 26. (See FIGS. 10–12.) The top beams 15 and 16 include slots, e.g., 15*a* in FIG. 4, that allow the connecting of the telescoping segment 22 with the slidable segment 26. The slots 27, 28 and 30 and the cavity 29 extend the entire length of the guide segment 25; and they are open at the ends of the segment 25.

Figure 10:
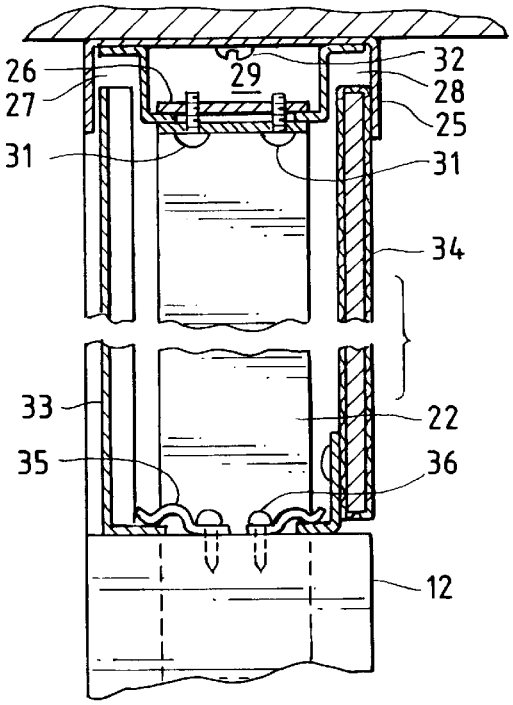
FIG. 10 is a sectional view showing the telescoping extension and panel members that close the space between the main body of the wall member and a ceiling.
Figure 11:
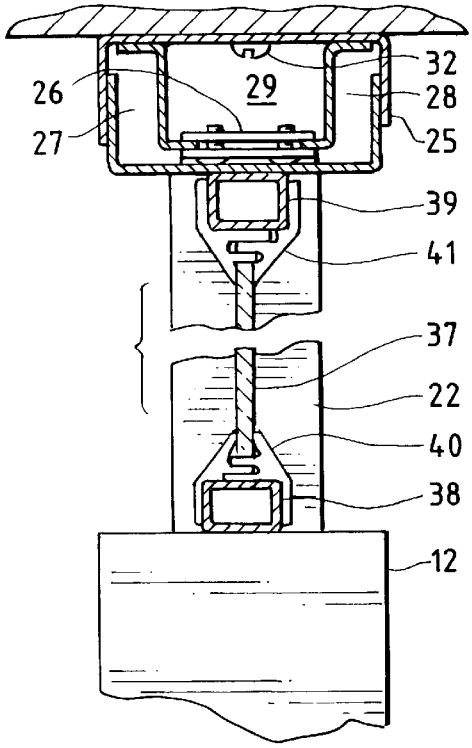
FIG. 11 is a sectional view showing a modification of the panel assembly that closes the space between the main body of the wall member and a ceiling.
Figure 12:
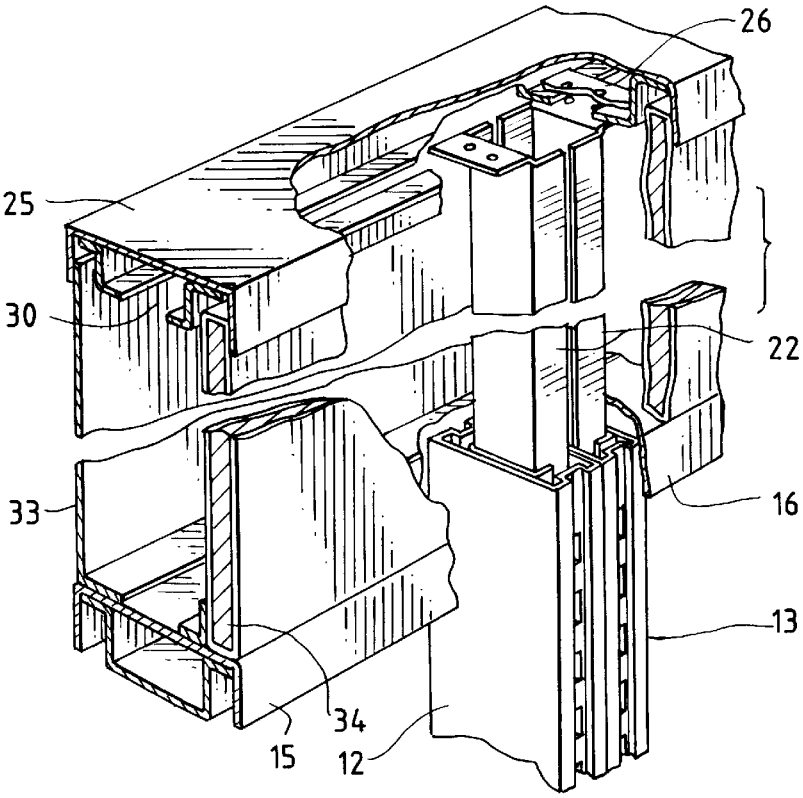
FIG. 12 is a partial perspective view of the arrangement shown in FIG. 10 with a portion cut away to show the telescoping extensions.

The slidable segments 26 lie inside the cavity 29 on flanges 25*b*' and 25*c*' disposed at opposite sides of the slot 30. These segments 26 may move freely in the longitudinal direction of the guide segment 25; but the walls of the cavity 29 (i.e., the Z-shaped angle portions 25*b* and 25*c*) stop the slidable segments 26 from moving transversely of the guide segment 25. Thus, the assembly 24 allows adjustment in the longitudinal direction but limits displacement in the transverse direction. Screws 32 or other suitable securing means secure the attaching assembly 24 to the ceiling C as shown in FIGS. 10 and 11.

To close the openings between the top beams 15 and 16 and the ceiling C, the wall member W may include panels 33 and 34 whose top ends extend into the slots 27 and 28, respectively, and whose bottom ends lie secured to the top beams 15 and 16, as at 35 and 36. (See FIGS. 10 and 12.) The wall member W may also include a glass panel 37 secured in place by tubes 38 and 39 and resilient holding tabs 40 and 41 (See FIG. 11). These panels 33, 34 and 37, in addition to closing the corresponding openings, give the wall member W a finished appearance. One may also eliminate one or more of these panels as well as the panels shown in FIG. 3 to leave an opening or openings in the wall member W.

Figure 6:
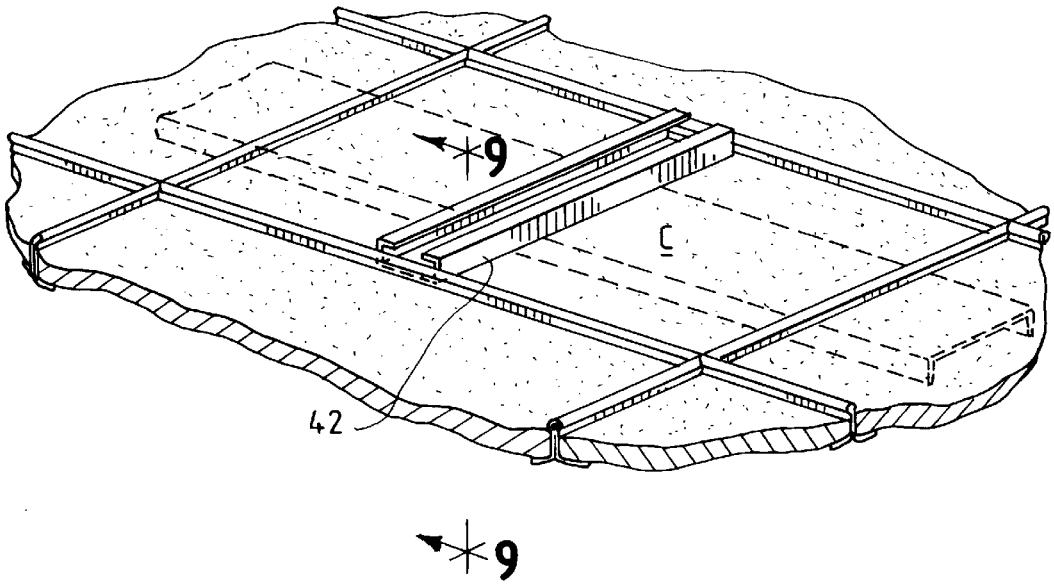
FIG. 6 is a perspective view of a drop ceiling showing a support member that forms a part of the connection between the telescoping extensions of the present invention and a ceiling panel.

In installations where the ceiling is a drop ceiling as shown in FIGS. 6–9, a support member 42 lies on top of a ceiling panel C as shown in FIG. 6 and distributes the load of the attaching assembly 24 over the entire panel. This member 42 is an elongate channel-like component with a flat face that engages the ceiling panel. Screws 32 or other suitable securing means connect the member 42 with the guide segment 25 and the ceiling panel C, sandwiching the panel C between the segment 25 and the member 42. (See FIG. 9.) Additionally, hanging members 42*a* and 42*b*, shown in phantom in FIG. 9, may suspend the member 42 from a permanent ceiling.

Figure 7:
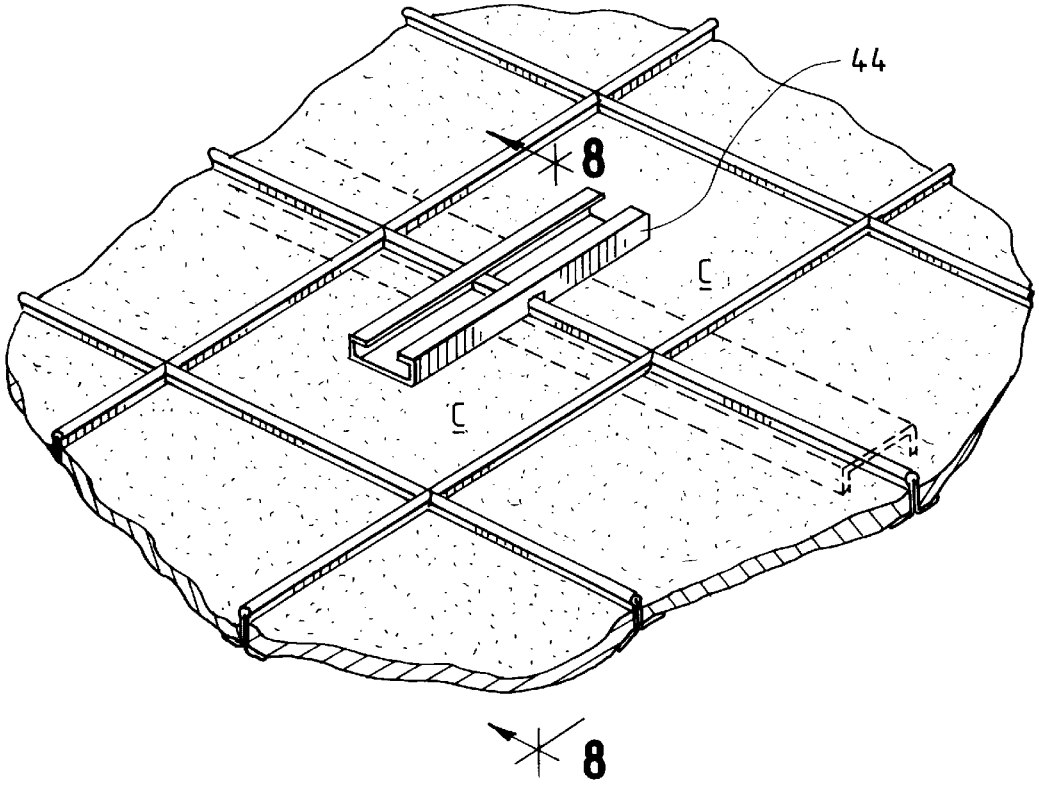
FIG. 7 is a perspective view showing a modification of the support member of FIG. 6.
Figure 8:
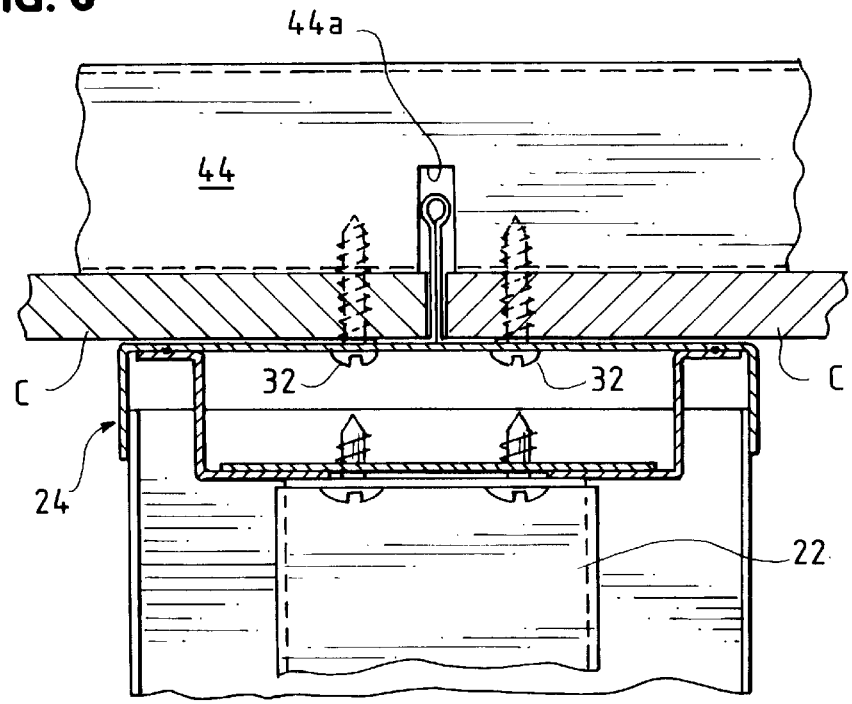
FIG. 8 is a sectional view taken along line 8—8 in FIG. 7.
Figure 9:
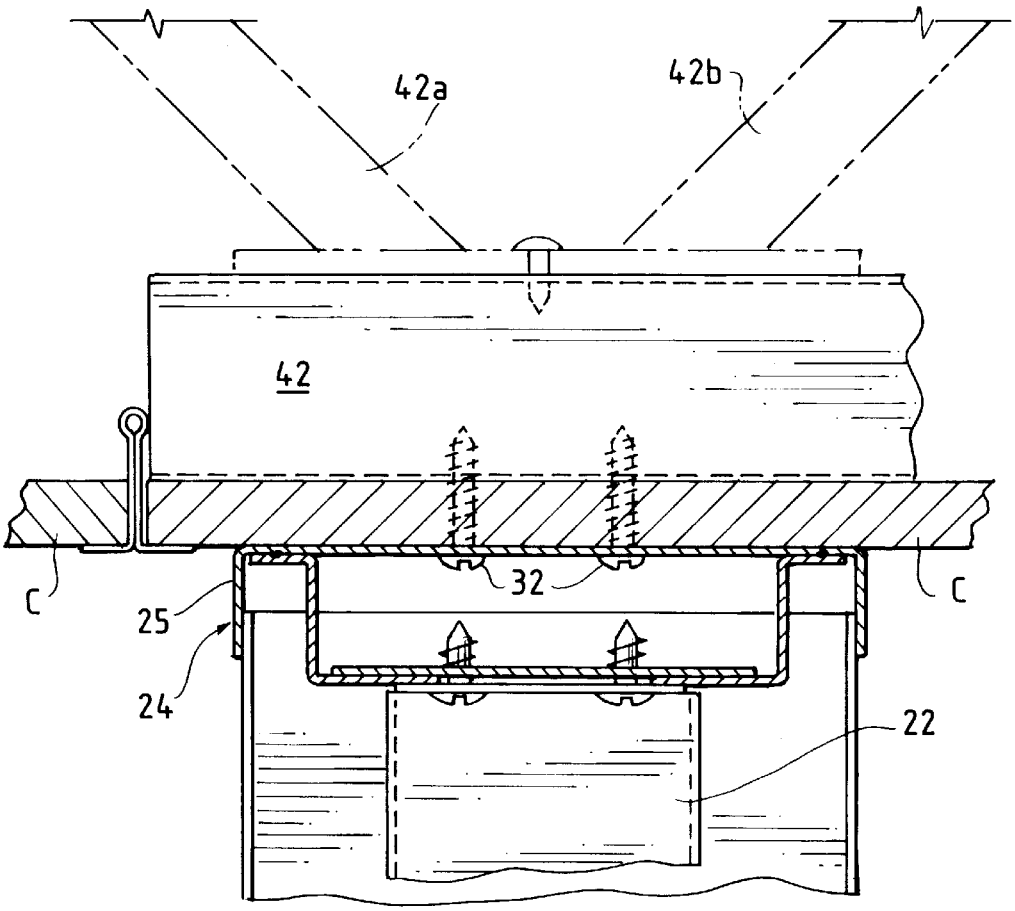
FIG. 9 is a sectional view taken along line 9—9 in FIG. 6.

FIGS. 7 and 8 show a modified support member 44. This member 44 includes a slot 44*a* which receives a frame member of the drop ceiling and allows the support member 44 to straddle this frame member and distribute the load of the attaching assembly 24 to two adjacent ceiling panels C.

While the above description and the drawings disclose and illustrate one embodiment and various modifications, one should understand, of course, that the invention is not limited to this embodiment and modifications. Those skilled in the art to which the invention pertains may make other modifications and other embodiments employing the principles of this invention, particularly upon considering the foregoing teachings. Therefore, by the appended claims, the applicants intend to cover any modifications and other embodiments as incorporate those features which constitute the essential features of this invention.

What is claimed is:

1. A partition system comprising: a wall member including a main body portion and a connecting portion disposed in telescoping relation with the main body portion; a separate elongate guide segment securable to a structural body; and a separate slidable segment disposed in longitudinally sliding relation with the guide segment, said slidable segment being removably secured to the connecting portion of the wall member; the wall member including a wall panel disposed between the main body portion and the structural body.

2. The partition system of claim 1, wherein the engaging portion is flat and plate-like.

3. The partition system of claim 2, wherein the slidable segment is flat and plate-like.

4. The partition system of claim 1, wherein the walls of the cavity limit movement of the slidable segment in a direction transversely of the guide segment.

5. The partition system of claim 4, wherein the cavity is rectangular in cross-section and the slidable segment has a rectangular configuration.

6. The partition system of claim 5, wherein the connecting portion of the wall member is connected to the slidable segment with a plurality of screws.

7. The partition system of claim 1, wherein the guide segment defines a cavity and includes an engaging portion for engaging the structural body and opposite edge portions for supporting the slidable segment and defining a slot that communicates with the cavity, the slidable segment being disposed in the cavity.

8. The partition system of claim 7, wherein the cavity extends the entire length of the guide segment and is open at the distal ends of the guide segment.

9. A partition apparatus comprising: a moveable wall member and a drop ceiling including a frame with a lattice of beams and at least one panel member; the moveable wall member being disposed on one side of the panel member; a support member disposed on an opposite side of the panel member; at least one securing member securing the wall member, panel member and support member together; said panel member being suspended at a predetermined position; at least one hanging member secured at one end to the support member and at an opposite end to a support body; the moveable wall member including a main body portion and a connecting portion disposed in telescoping relation with the main body portion; a separate guide segment secured to the drop ceiling; and a separate slidable segment disposed in sliding relation with the guide segment; the slidable segment being removably secured to the connecting portion of the wall member; the wall member including a wall panel disposed between the main body portion and the drop ceiling.

10. A partition system comprising: a wall member with a main body segment placeable in spaced relation with a structural body and with a telescoping segment disposed in telescoping relation with the main body segment for bridging the space between the main body segment and the structural body to connect the main body segment to the structural body; a guide segment securable to the structural body; and a slidable segment disposed in sliding relation with the guide segment and removably secured to the telescoping segment of the wall member; the guide segment defining a cavity and including an engaging portion for engaging the structural body and opposite edge portions for defining a slot that communicates with the cavity, the slidable segment being disposed in the cavity across the slot.

11. The partition system of claim 10, further comprising a support member placeable against the structural body opposite the guide segment and a securing member for securing the guide segment, the structural body and the support member together.

* * * * *